US009979136B1

(12) United States Patent
Wu et al.

(10) Patent No.: US 9,979,136 B1
(45) Date of Patent: May 22, 2018

(54) HIGH SPEED CONNECTOR AND TRANSMISSION MODULE THEREOF

(71) Applicant: Greenconn Corporation, New Taipei (TW)

(72) Inventors: Kun-Shen Wu, New Taipei (TW); Keh-Chang Cheng, New Taipei (TW)

(73) Assignee: GREENCONN CORPORATION, New Taipei (TW)

( * ) Notice: Subject to any disclaimer, the term of this patent is extended or adjusted under 35 U.S.C. 154(b) by 0 days. days.

(21) Appl. No.: 15/849,706

(22) Filed: Dec. 21, 2017

Related U.S. Application Data

(63) Continuation-in-part of application No. 15/633,137, filed on Jun. 26, 2017.

(51) Int. Cl.

| | |
|---|---|
| ***H01R 12/70*** | (2011.01) |
| ***H01R 13/6599*** | (2011.01) |
| ***H01R 12/50*** | (2011.01) |
| ***H01R 13/6596*** | (2011.01) |
| ***H01R 13/652*** | (2006.01) |
| ***H01R 24/60*** | (2011.01) |
| ***H01R 13/6598*** | (2011.01) |
| *H01R 107/00* | (2006.01) |

(52) U.S. Cl.
CPC ..... *H01R 13/6596* (2013.01); *H01R 13/652* (2013.01); *H01R 13/6598* (2013.01); *H01R 24/60* (2013.01); *H01R 2107/00* (2013.01)

(58) Field of Classification Search
CPC ..... H01R 13/6599; H01R 12/50; H01R 12/70
See application file for complete search history.

(56) References Cited

U.S. PATENT DOCUMENTS

| | | | | |
|---|---|---|---|---|
| 6,413,103 | B1 * | 7/2002 | Merz | G06F 1/1616 174/117 FF |
| 6,544,072 | B2 * | 4/2003 | Olson | H01R 13/6599 439/607.02 |
| 7,156,690 | B2 * | 1/2007 | Tolmie | G02B 6/3817 439/439 |
| 7,371,128 | B2 * | 5/2008 | DeLessert | G01R 1/06772 439/700 |
| 7,922,507 | B2 * | 4/2011 | Wang | H01R 13/703 439/188 |
| 2003/0129872 | A1 * | 7/2003 | Tolmie | G02B 6/3817 439/577 |

* cited by examiner

*Primary Examiner* — Briggitte R Hammond
(74) *Attorney, Agent, or Firm* — Li & Cai Intellectual Property (USA) Office

(57) ABSTRACT

A transmission module of a high speed connector includes an insulating core, two shielding members, two first differential signal terminals, two first grounding terminals, two second differential signal terminals, and two second grounding terminals, the latter four of which are fixed on the insulating core. The two shielding members respectively include a first metallic coating layer connected to the two first grounding terminals and a second metallic coating layer connected to the two second grounding terminals. The first metallic coating layer and the second metallic coating layer are respectively arranged at an upper side and a lower side of the first and second differential signal terminals, so that the first and second metallic coating layers can shield the first and second differential signal terminals in a height direction.

10 Claims, 16 Drawing Sheets

HIGH SPEED CONNECTOR AND TRANSMISSION MODULE THEREOF

CROSS REFERENCE TO RELATED APPLICATION

This application is a continuation-in-part of U.S. application Ser. No. 15/633,137 filed on Jun. 26, 2017 and entitled "HIGH SPEED CONNECTOR AND TRANSMISSION MODULE THEREOF", now pending.

BACKGROUND OF THE INVENTION

1. Field of the Invention

The present disclosure relates to a connector; in particular, to a high speed connector and a transmission module thereof.

2. Description of Related Art

A conventional high speed connector is provided with a grounding sheet to connect with a plurality of grounding terminals thereof, thereby reducing insertion loss and crosstalk. A conventional grounding sheet has a sheet portion and a plurality of elastic arms integrally extending from the sheet portion. The elastic arms are formed in a cantilever beam mode, and are integrally formed with the sheet portion by using a punching process. However, the conventional grounding sheet does not have a good structural strength, and is not formed with any portion to shield the differential signal terminals of the conventional high speed connector. Thus, the performance of the conventional high speed connector cannot be increased by adapting the conventional grounding sheet.

SUMMARY OF THE INVENTION

The present disclosure provides a high speed connector and a transmission module thereof to solve the drawbacks associated with conventional high speed connectors.

The present disclosure discloses a high speed connector, which includes a housing, an insulating core inserted into the housing, a plurality of first conductive terminals fixed on the insulating core and arranged in one row parallel to a width direction, a plurality of second conductive terminals fixed on the insulating core and arranged in one row parallel to the width direction, a first shielding member, and a second shielding member. Each of the first conductive terminals is substantially arranged in the housing. The first conductive terminals include two first differential signal terminals and two first grounding terminals, and the two first grounding terminals are respectively arranged at two opposite outer sides of the two first differential signal terminals. The second conductive terminals are substantially arranged in the housing and respectively correspond in position to the first conductive terminals in a height direction perpendicular to the width direction. A length of each of the second conductive terminals is less than or equal to that of each of the first conductive terminals. The second conductive terminals include two second differential signal terminals and two second grounding terminals, and the two second grounding terminals are respectively arranged at two opposite outer sides of the two second differential signal terminals. The first shielding member includes a first substrate detachably fastened to the housing and a first metallic coating layer coated on the first substrate. The first metallic coating layer is abutted against the two first grounding terminals to establish an electrical connection between the two first grounding terminals. The first metallic coating layer is arranged at an upper side of the two first differential signal terminals in the height direction, and the first metallic coating layer is configured to shield the two first differential signal terminals in the height direction. The second shielding member includes a second substrate detachably fastened to the housing and a second metallic coating layer coated on the second substrate. The second metallic coating layer is abutted against the two second grounding terminals to establish an electrical connection between the two second grounding terminals. The second metallic coating layer is arranged at a lower side of the two second differential signal terminals in the height direction, and the second metallic coating layer is configured to shield the two second differential signal terminals in the height direction.

The present disclosure also discloses a transmission module of a high speed connector. The transmission module includes an insulating core, two first differential signal terminals and two first grounding terminals respectively arranged at two opposite outer sides of the two first differential signal terminals, two second differential signal terminals and two second grounding terminals respectively arranged at two opposite outer sides of the two second differential signal terminals, a first shielding member, and a second shielding member. A length of each of the two first differential signal terminals is substantially equal to that of each of the two first grounding terminals. The two first differential signal terminals and the two first grounding terminals are fixed on the insulating core and are arranged in one row parallel to a width direction. A length of each of the two second differential signal terminals is substantially equal to that of each of the two second grounding terminals, and is less than the length of each of the two first differential signal terminals. The two second differential signal terminals and the two second grounding terminals are fixed on the insulating core, are arranged in one row parallel to the width direction, and respectively correspond in position to the first conductive terminals in a height direction perpendicular to the width direction. The first shielding member includes a first substrate and a first metallic coating layer coated on the first substrate. The first metallic coating layer is abutted against the two first grounding terminals to establish an electrical connection between the two first grounding terminals. The first metallic coating layer is arranged at an upper side of the two first differential signal terminals in the height direction, and the first metallic coating layer is configured to shield the two first differential signal terminals in the height direction. The second shielding member includes a second substrate and a second metallic coating layer coated on the second substrate. The second metallic coating layer is abutted against the two second grounding terminals to establish an electrical connection between the two second grounding terminals. The second metallic coating layer is arranged at a lower side of the two second differential signal terminals in the height direction, and the second metallic coating layer is configured to shield the two second differential signal terminals in the height direction.

In summary, for the high speed connector (or the transmission module) in the present disclosure, the first and second shielding members are provided with a shielding function for the first and second differential signal terminals by using the first and second metallic coating layers, so that the quality and the performance of signal transmission of the high speed connector (or the transmission module) can be effectively improved. Moreover, for the high speed connector (or the transmission module) in the present disclosure, the first and second substrates each having a better structural strength can be configured to support the first and second metallic coating layers by respectively coating the first and second metallic coating layers on the first and second substrates, so that the first and second metallic coating layers are not deformed easily.

In order to further appreciate the characteristics and technical contents of the present disclosure, references are hereunder made to the detailed descriptions and appended drawings in connection with the present disclosure. However, the appended drawings are merely shown for exemplary purposes, and should not be construed as restricting the scope of the present disclosure.

DETAILED DESCRIPTION OF THE PREFERRED EMBODIMENTS

References are hereunder made to the detailed descriptions and appended drawings in connection with the present disclosure. However, the appended drawings are merely provided for exemplary purposes, and should not be construed as restricting the scope of the present disclosure.

Figure 1:
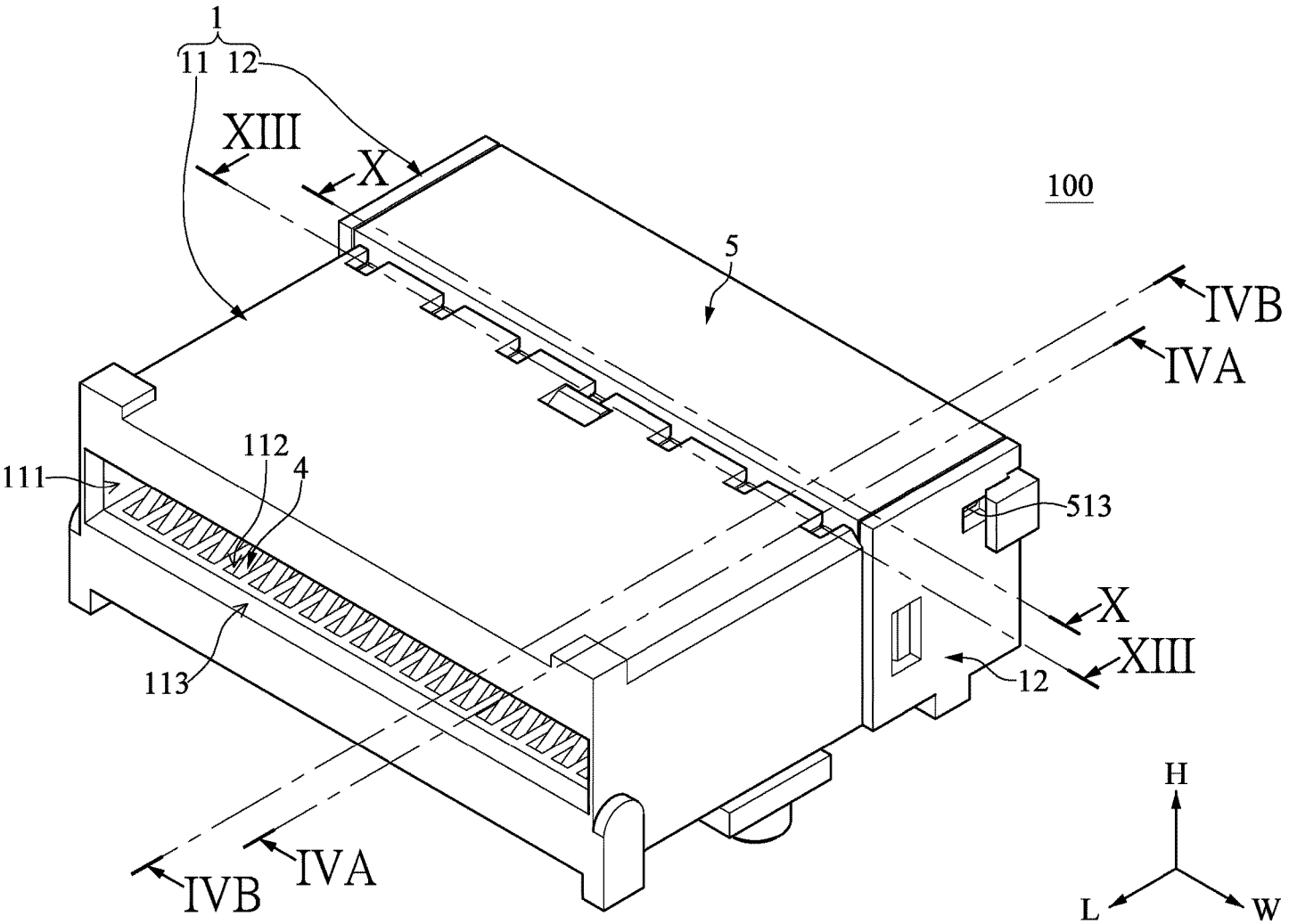
FIG. 1 is a perspective view showing a high speed connector according to an embodiment of the present disclosure.
Figure 2:
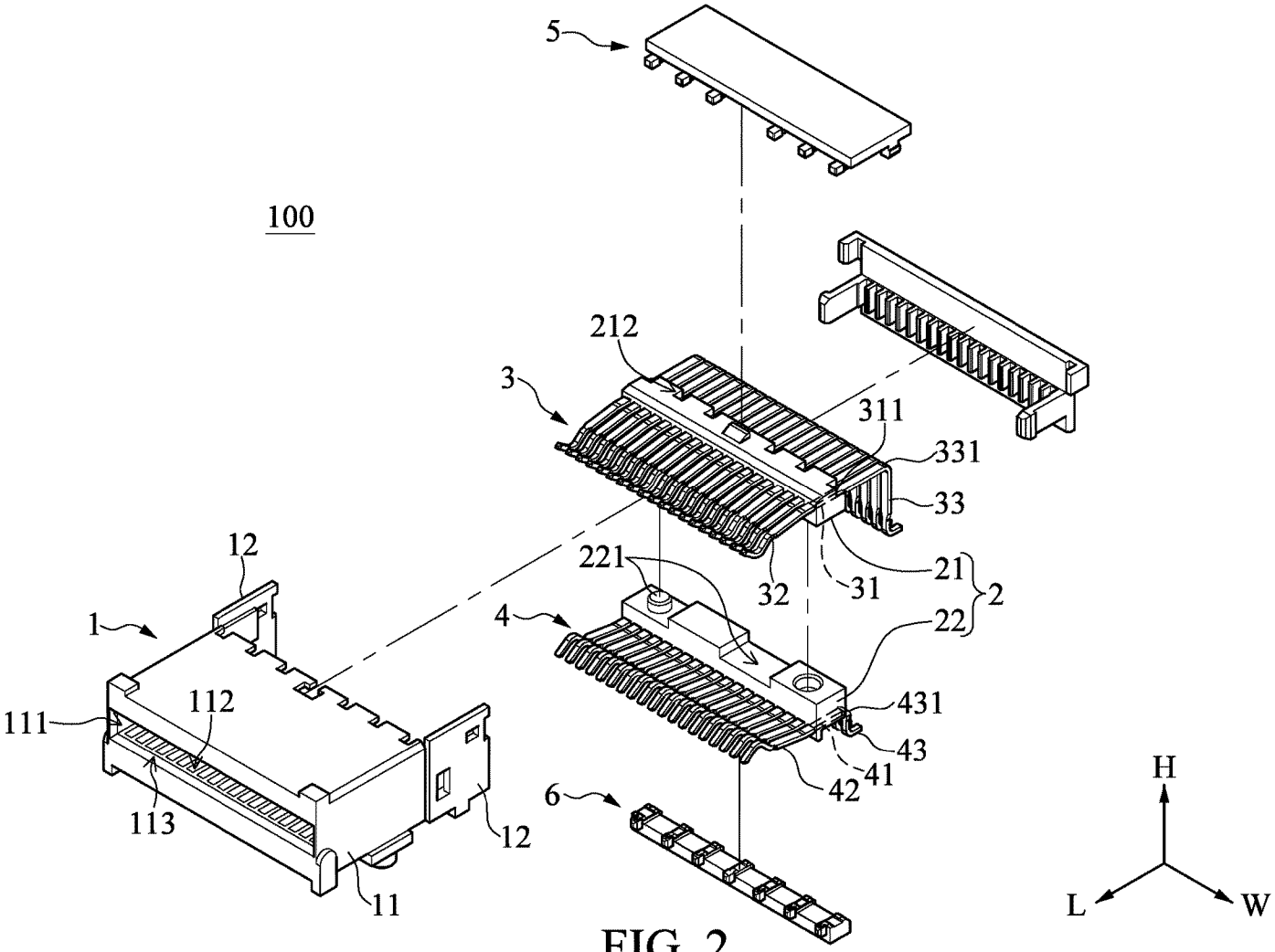
FIG. 2 is an exploded view of FIG. 1.
Figure 3:
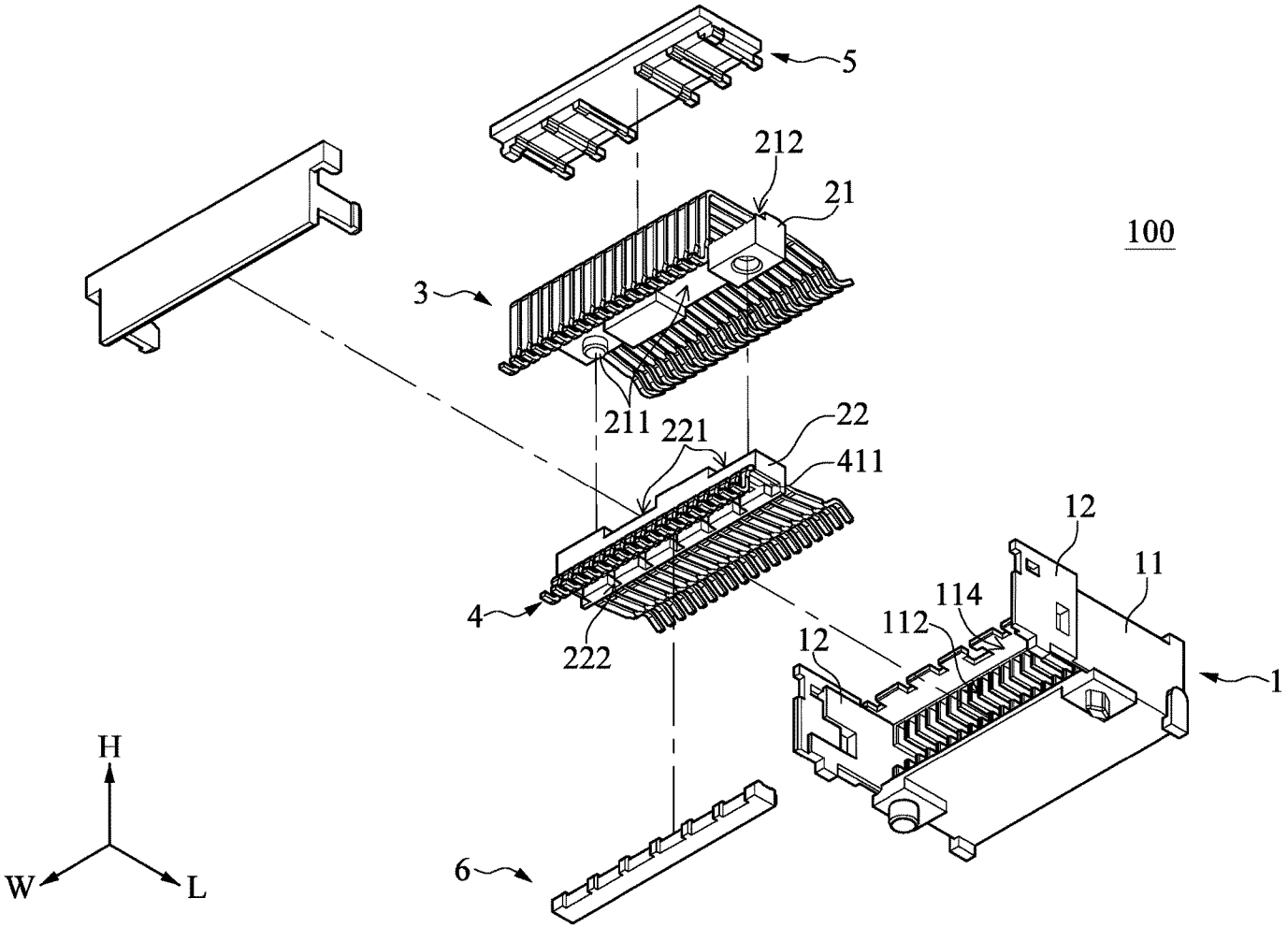
FIG. 3 is an exploded view of FIG. 1 from another perspective.

Reference is made to FIGS. 1 to 15, which illustrate an embodiment of the present disclosure. As shown in FIGS. 1 to 3, the present embodiment discloses a high speed connector 100; in particular, to a right angle connector, but the present disclosure is not limited thereto. For example, in other embodiments of the present disclosure, the high speed connector 100 can be a vertical connector. The high speed connector 100 in the present embodiment includes a housing 1, an insulating core 2 inserted into the housing 1, a plurality of first conductive terminals 3 fixed on the insulating core 2, a plurality of second conductive terminals 4 fixed on the insulating core 2, a first shielding member 5, and a second shielding member 6, the latter two of which are fastened to the insulating core 2 and/or the housing 1. Additionally, in other embodiments of the present disclosure, the high speed connector 100 can be provided with a metallic case disposed around the housing 1 according to design requirements. The following description discloses the structure and connection of each component of the high speed connector 100.

In order to clearly describe the present embodiment, the housing 1 defines a width direction W, a longitudinal direction L, and a height direction H, in which the width direction W, the longitudinal direction L and the height direction H are perpendicular to each other. As shown in FIGS. 2 to 4B, the housing 1 includes a main portion 11 and two positioning sheets 12 respectively extending from two opposite sides of a rear end of the main portion 11. The main portion 11 has an inserting channel 111 and a plurality of terminal slots 112 arranged in two rows. The two rows of the terminal slots 112 are respectively arranged above and under the inserting channel 111, and are in air communication with the inserting channel 111. Each row of the terminal slot 112 is arranged in the width direction W of the housing 1. The main portion 11 has an inserting opening 113 formed on a front end thereof and a receiving slot 114 formed on the rear end thereof. The inserting opening 113 and the receiving slot 114 are respectively arranged at a front side and a rear side of the inserting channel 111, and are in air communication with the inserting channel 111.

As shown in FIGS. 2 to 4B, the insulating core 2 is inserted into the housing 1, and the insulating core 2 in the present embodiment is inserted into the receiving slot 114 of the housing 1 to be a boundary of the inserting channel 111, but the present disclosure is not limited thereto. The insulating core 2 includes a first plastic core 21 and a second plastic core 22. The first plastic core 21 has a rugged structure 211, the second plastic core 22 has a mating structure 221, and the first plastic core 21 is fixed on the second plastic core 22 by detachably inserting the rugged structure 211 into the mating structure 221.

In addition, the insulating core 2 in the present embodiment adapts the first plastic core 21 and the second plastic core 22 inserted into the first plastic core 21, but the present disclosure is not limited thereto. That is to say, the insulating core 2 can be adjusted according to practical needs. In other embodiments of the present disclosure, the insulating core 2 can be integrally formed as a one-piece structure.

Figure 4A:
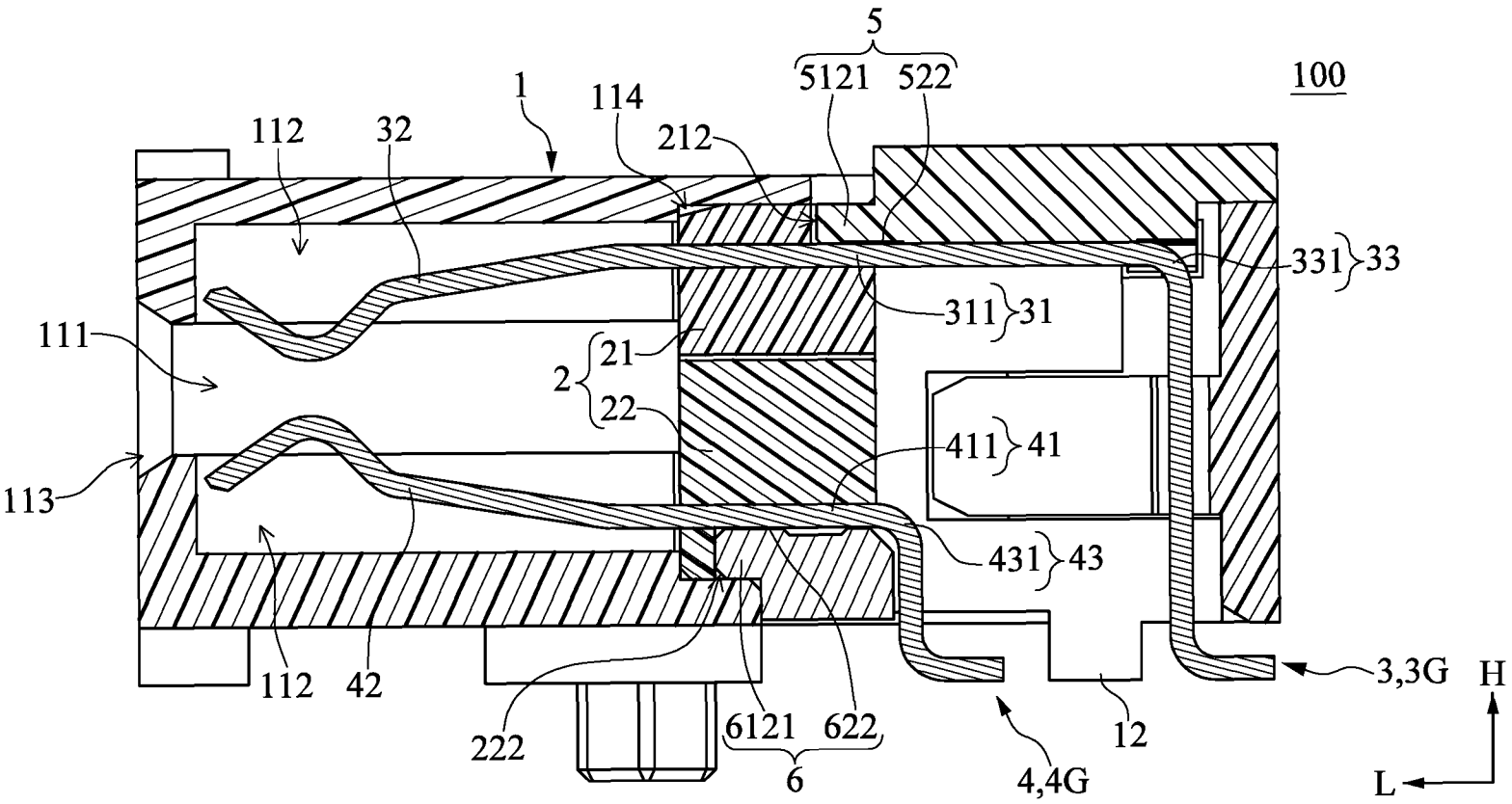
FIG. 4A is a cross-sectional view taken along a cross-sectional line IVA-IVA of FIG. 1.

As shown in FIGS. 2 and 4A, the first conductive terminals 3 are arranged in one row parallel to the width direction W, and are fixed on the first plastic core 21. Each of the first conductive terminals 3 is substantially arranged in the housing 1. Each of the first conductive terminals 3 has a first embedded segment 31 fixed and embedded in the first plastic core 21 of the insulating core 2, a first contacting segment 32 extending from the first embedded segment 31 toward the inserting opening 113, and a first fixing segment 33 extending from the first embedded segment 31 in a direction away from the inserting opening 113. That is to say, the first contacting segments 32 are respectively arranged in the upper row of the terminal slots 112 of the main portion 11, and each of the first contacting segments 32 is partially located in the inserting channel 111. The first fixing segments 33 are arranged between the two positioning sheets 12. Specifically, each of the first fixing segments 33 has a first bending corner 331 arranged behind a portion thereof extending from the respective first embedded segment 31 in the longitudinal direction L, and the first bending corner 331 of each of the first fixing segments 33 in the present embodiment has an angle of 90 degrees. In other words, each of the first fixing segments 33 has a first portion (not labeled) extending from the respect embedded segment 31 in the longitudinal direction L, a second portion parallel to the height direction H (not labeled), and the first bending corner 331 connected to the first portion and the second portion.

Figure 5:
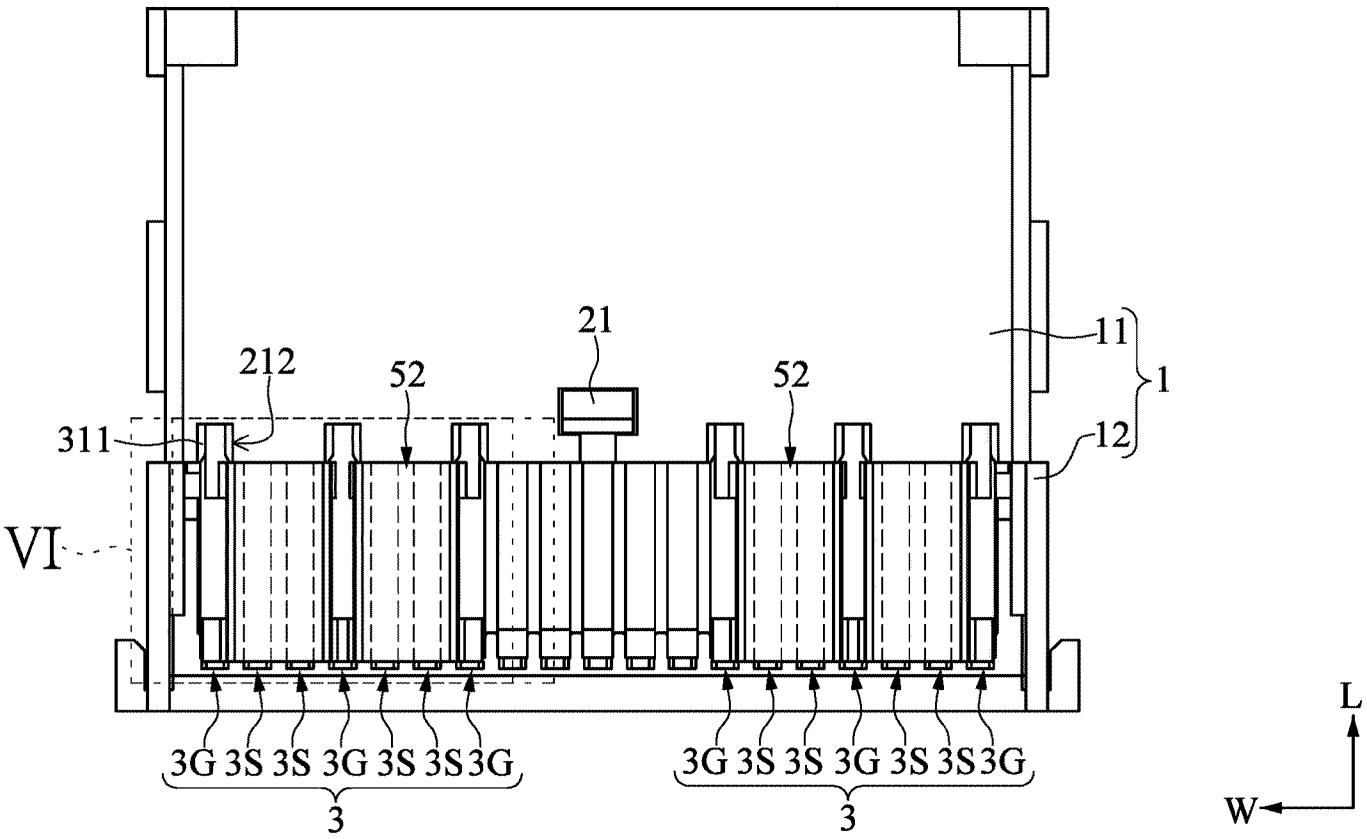
FIG. 5 is a top planar view of FIG. 1 when a first substrate is omitted.
Figure 6:
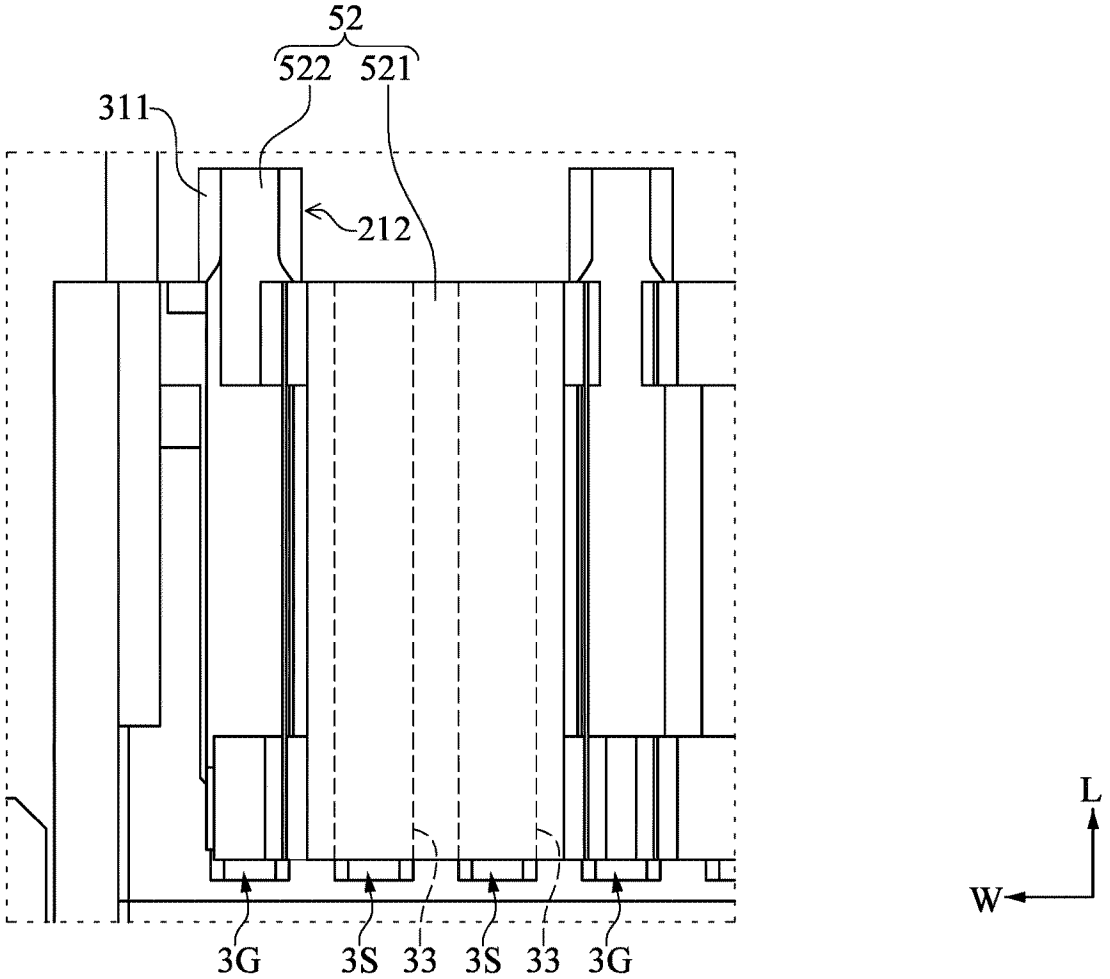
FIG. 6 is an enlarged view showing a portion VI of FIG. 5.

Moreover, as shown in FIGS. 2, 5, and 6, when the first conductive terminals 3 are named according to function or application thereof, the first conductive terminals 3 include a plurality of pairs of first differential signal terminals 3S and a plurality of first grounding terminals 3G. Each pair of first differential signal terminals 3S is arranged between two of the first grounding terminals 3G, and the pairs of first differential signal terminals 3S and the first grounding terminals 3G in the present embodiment are substantially arranged in a bilateral symmetry. The insulating core 2 (i.e., the first plastic core 21) has a plurality of first notches 212 (as shown in FIG. 2 or FIG. 5), and parts of the first grounding terminals 3G (i.e., a rear portion of the first embedded segment 31 of each first grounding terminal 3G) are respectively exposed from the insulating core 2 though the first notches 212 and each is defined as a first external connecting portion 311.

Thus, the first external connecting portions 311 are embedded in the insulating core 2 (i.e., the first plastic core 21) having a greater structural strength, so that when each of the first external connecting portions 311 is abutted against the other component (i.e., the first shielding member 5), the insulating core 2 can support each of the first external connecting portions 311 to prevent deformation, thereby maintaining a stable connection between each of the first external connecting portions 311 and the abutted component.

As shown in FIGS. 2 and 4A, the second conductive terminals 4 are arranged in one row parallel to the width direction W, and are fixed on the second plastic core 22. Each of the second conductive terminals 4 is substantially arranged in the housing 1. A length of each of the second conductive terminals 4 is less than or equal to that of each of the first conductive terminals 3. Each of the second conductive terminals 4 has a second embedded segment 41 fixed and embedded in the second plastic core 22 of the insulating core 2, a second contacting segment 42 extending from the second embedded segment 41 toward the inserting opening 113, and a second fixing segment 43 extending from the second embedded segment 41 in a direction away from the inserting opening 113. That is to say, the second contacting segments 42 are respectively arranged in the lower row of the terminal slots 112 of the main portion 11, and each of the second contacting segments 42 is partially located in the inserting channel 111. The second fixing segments 43 are substantially arranged between the two positioning sheets 12. Each of the second fixing segments 43 has a second bending corner 431 arranged behind a portion thereof extending from the respective second embedded segment 41 and protruding from the second plastic core 22 of the insulating core 2, and the second bending corner 431 of each of the second fixing segments 43 in the present embodiment has an angle of 90 degrees.

Specifically, a length of each of the second embedded segments 41 is equal to that of each of the first embedded segments 31, a length of each of the second contacting segments 42 is equal to that of each of the first contacting segments 32, and a length of each of the second fixing segments 43 is less than that of each of the second contacting segments 33.

Figure 7:
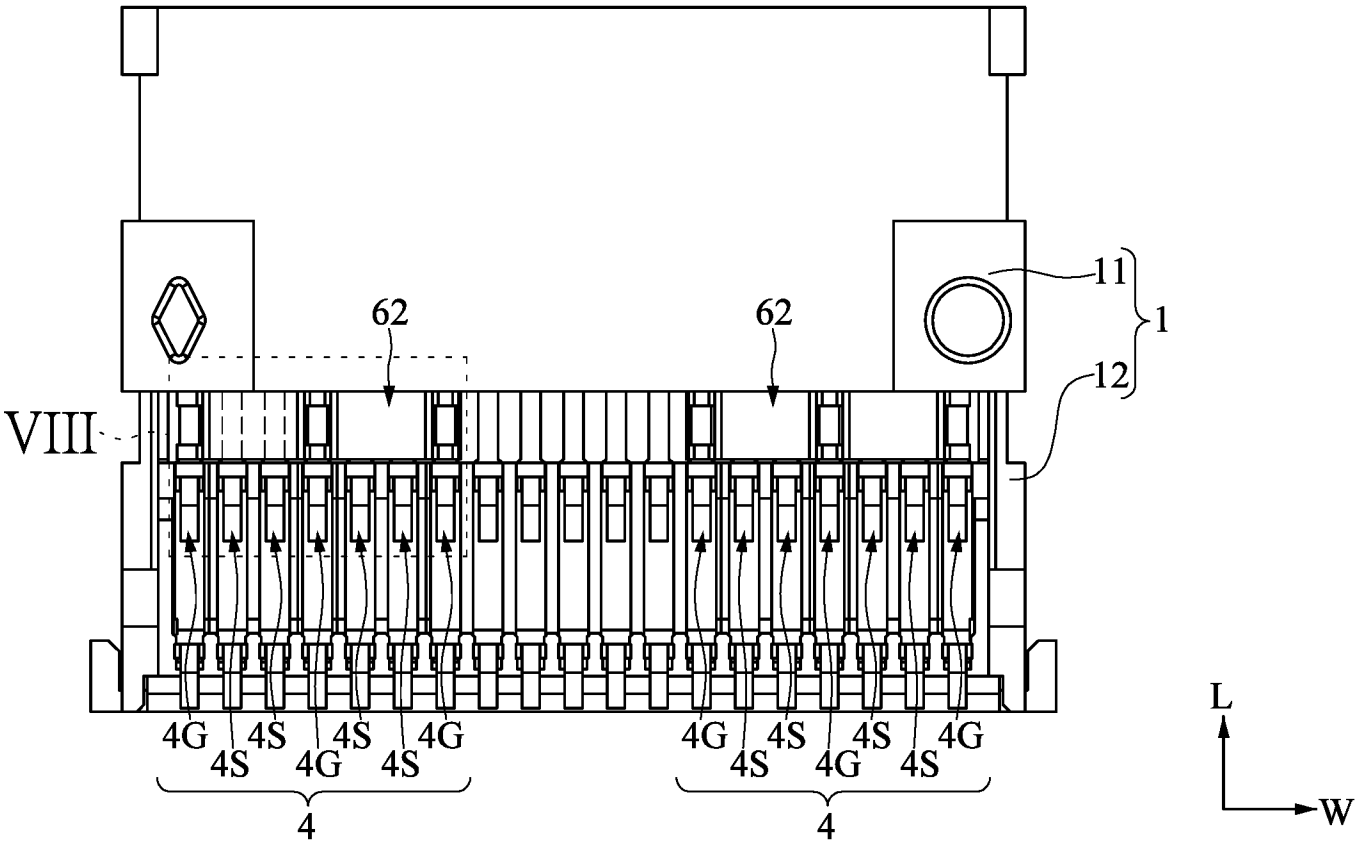
FIG. 7 is a bottom planar view of FIG. 1 when a second substrate is omitted.
Figure 8:
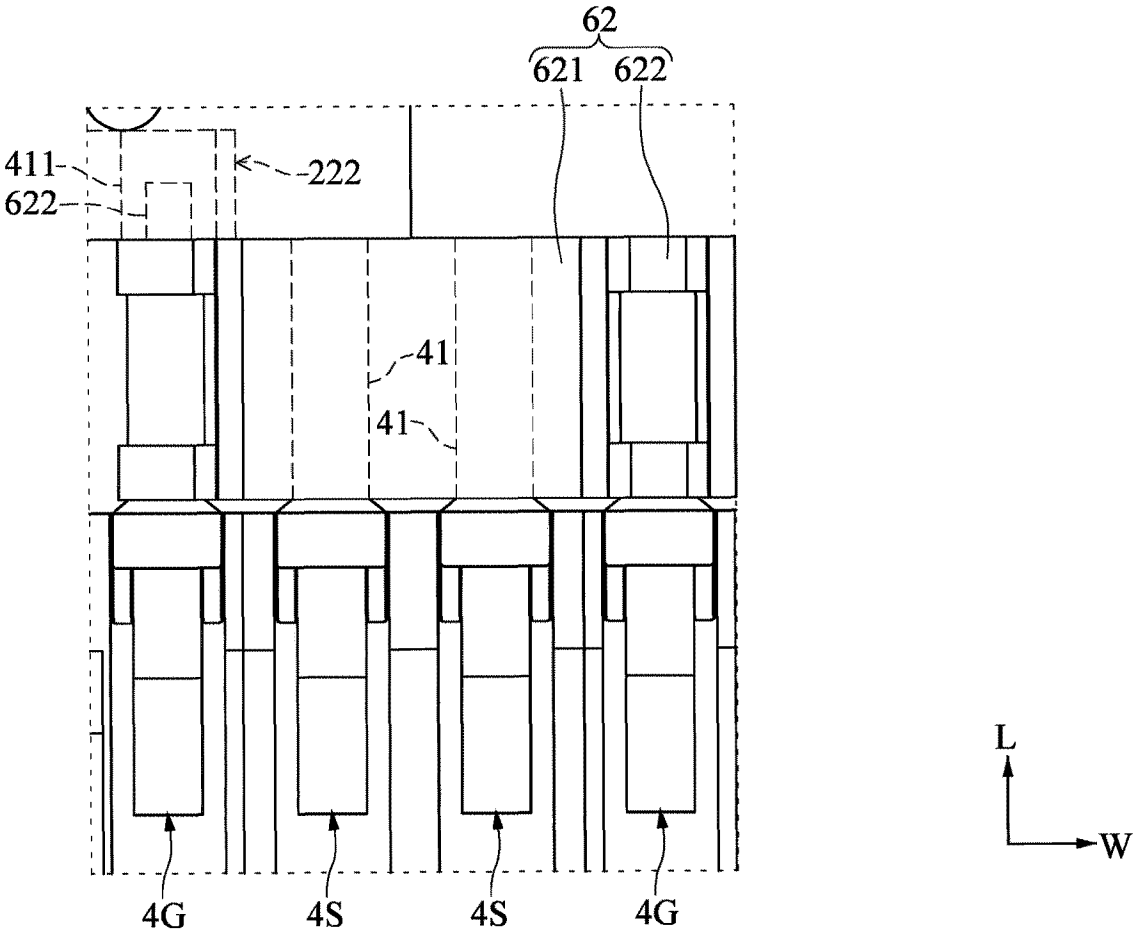
FIG. 8 is an enlarged view showing a portion VIII of FIG. 7.

In other words, as shown in FIGS. 2, 3, 7, and 8, when the second conductive terminals 4 are named according to function or application thereof, the second conductive terminals 4 include a plurality of pairs of differential signal terminals 4S and a plurality of grounding terminals 4G. Each pair of second differential signal terminals 4S is arranged between two of the second grounding terminals 4G, and the pairs of second differential signal terminals 4S and the second grounding terminals 4G in the present embodiment are substantially arranged in a bilateral symmetry. The insulating core 2 (i.e., the second plastic core 22) has a plurality of second notches 222 (as shown in FIG. 3 or FIG. 8), and parts of the second grounding terminals 4G (i.e., a rear portion of the second embedded segment 41 of each second grounding terminal 4G) are respectively exposed from the insulating core 2 though the second notches 222 and each is defined as a second external connecting portion 411.

Thus, the second external connecting portions 411 are embedded in the insulating core 2 (i.e., the second plastic core 22) having a greater structural strength, so that when each of the second external connecting portions 411 is abutted against the other component (i.e., the second shielding member 6), the insulating core 2 can support each of the second external connecting portions 411 to prevent deformation, thereby maintaining a stable connection between each of the second external connecting portions 411 and the abutted component.

Figure 9:
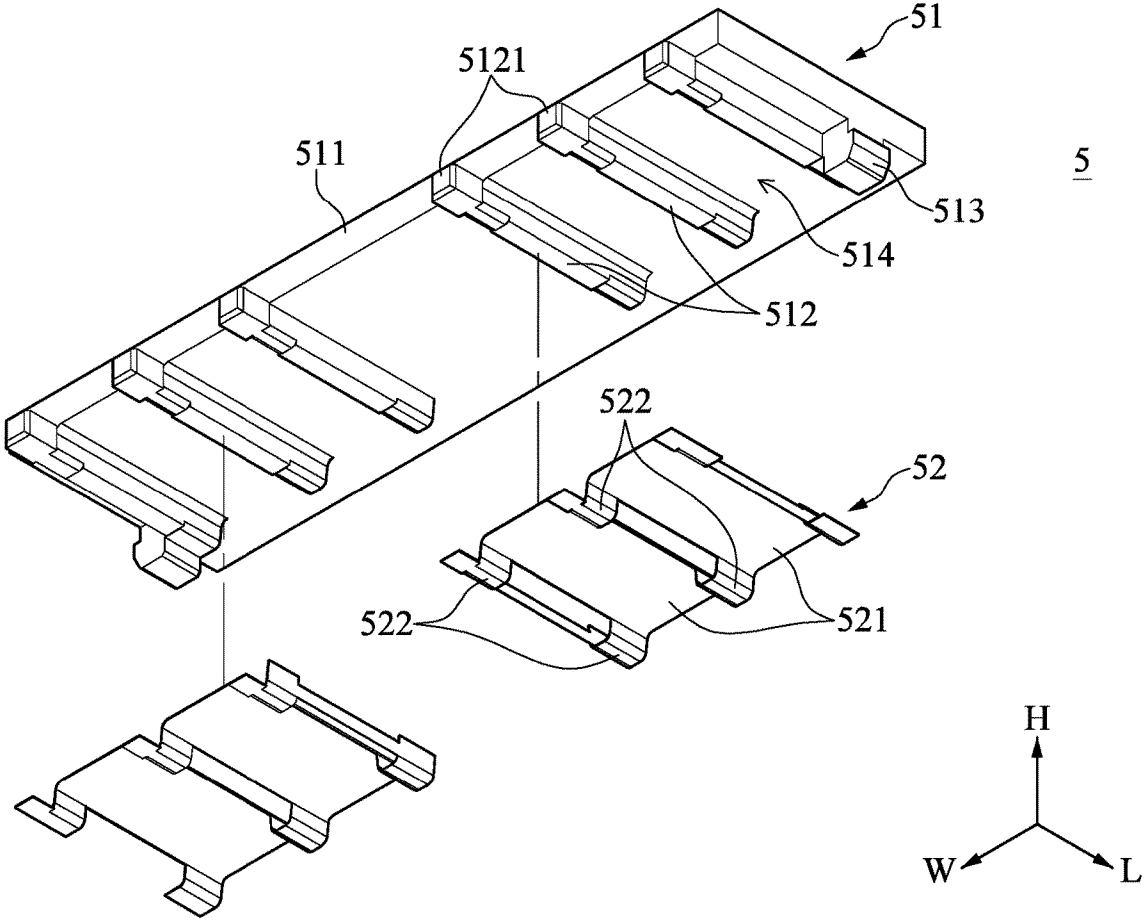
FIG. 9 is an exploded view of a first shielding member according to the present embodiment.
Figure 10:
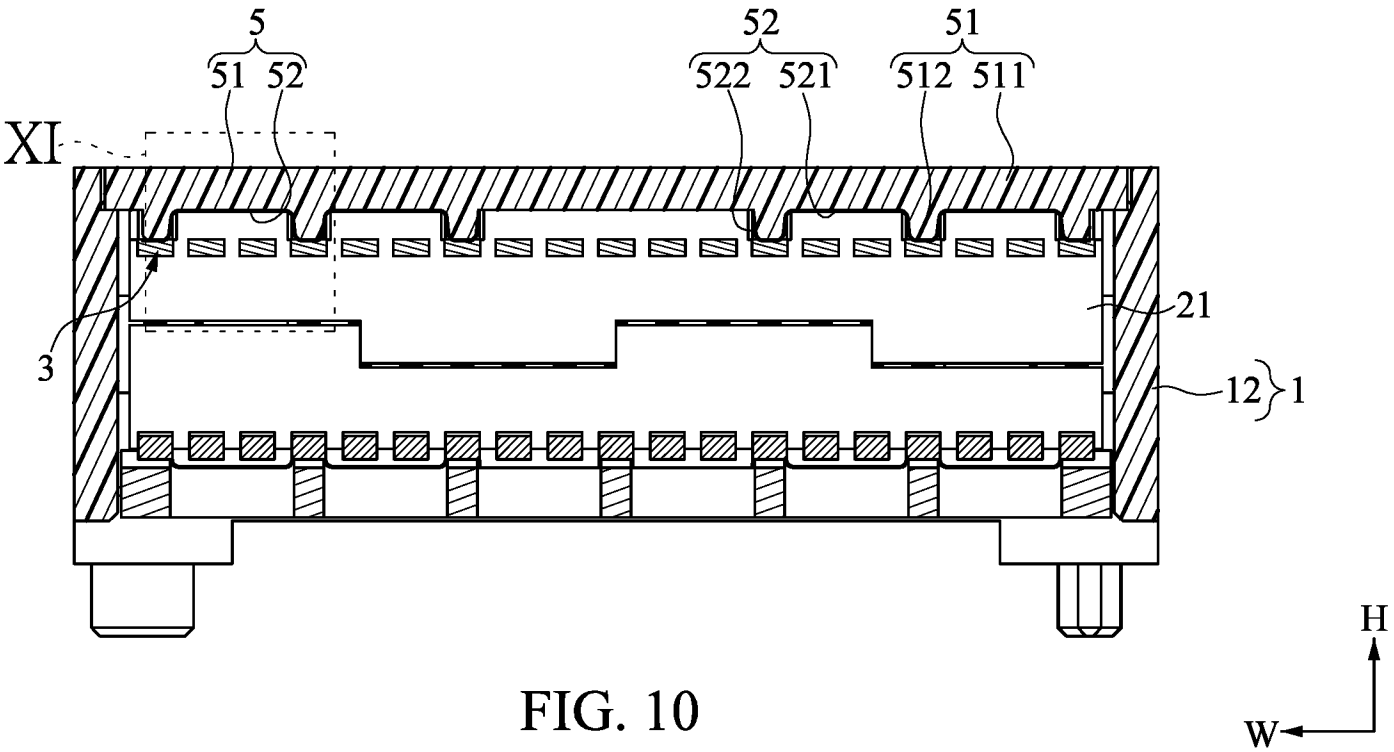
FIG. 10 is a cross-sectional view taken along a cross-sectional line X-X of FIG. 1.
Figure 11:
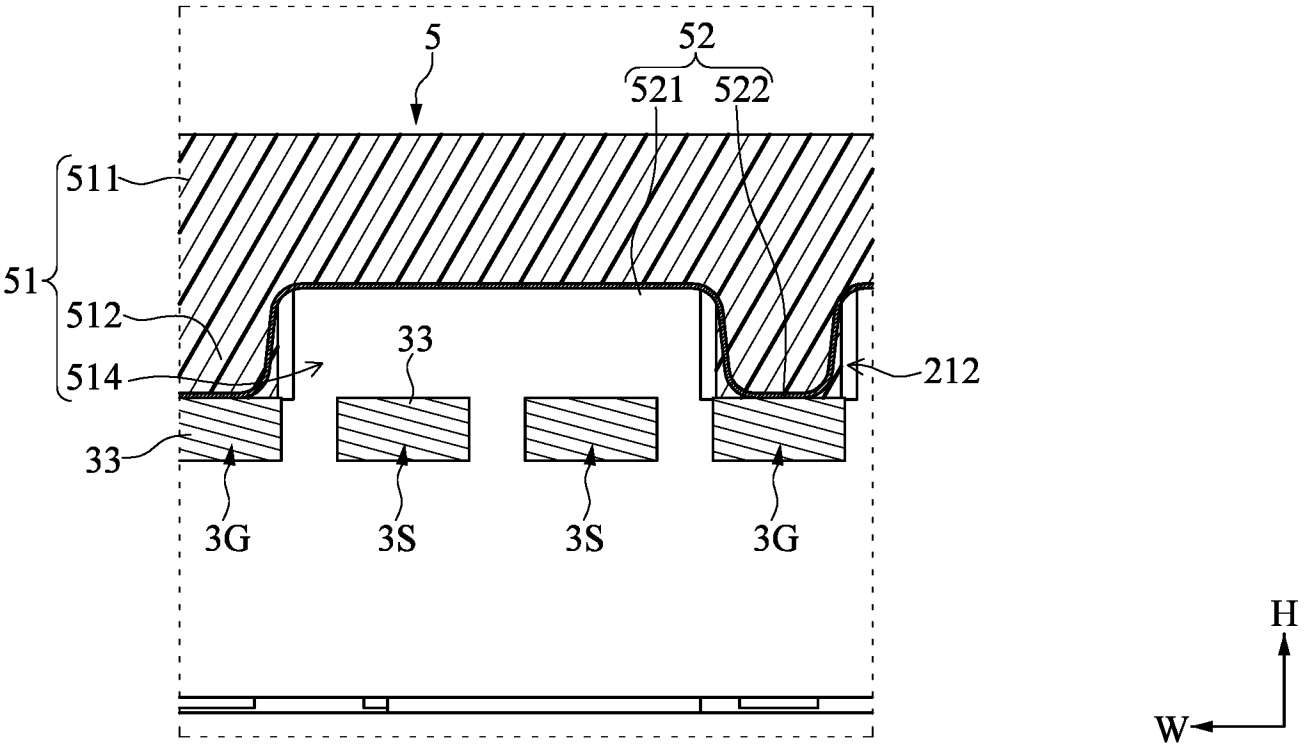
FIG. 11 is an enlarged view showing a portion XI of FIG. 10.

As shown in FIG. 2, each of the first shielding member 5 and the second shielding member 6 in the present embodiment is an LDS shielding member, but the present disclosure is not limited thereto. As shown in FIGS. 9 to 11, the first shielding member 5 includes a first substrate 51 and a first metallic coating layer 52 coated on the first substrate 51. The first metallic coating layer 52 can be integrally formed as a one-piece structure or can be a plurality of separated parts. The first substrate 51 in the present embodiment is integrally formed as a one-piece structure, and the first metallic coating layer 52 is abutted against at least two of the first grounding terminals 3G of the first conductive terminals 3 to establish an electrical connection between the at least two abutted first grounding terminals 3G. Thus, the first substrate 51 having a better structural strength can be configured to support the first metallic coating layer 52 by coating the first metallic coating layer 52 on the first substrate 51, so that the first metallic coating layer 52 is not easily deformed.

Figure 12:
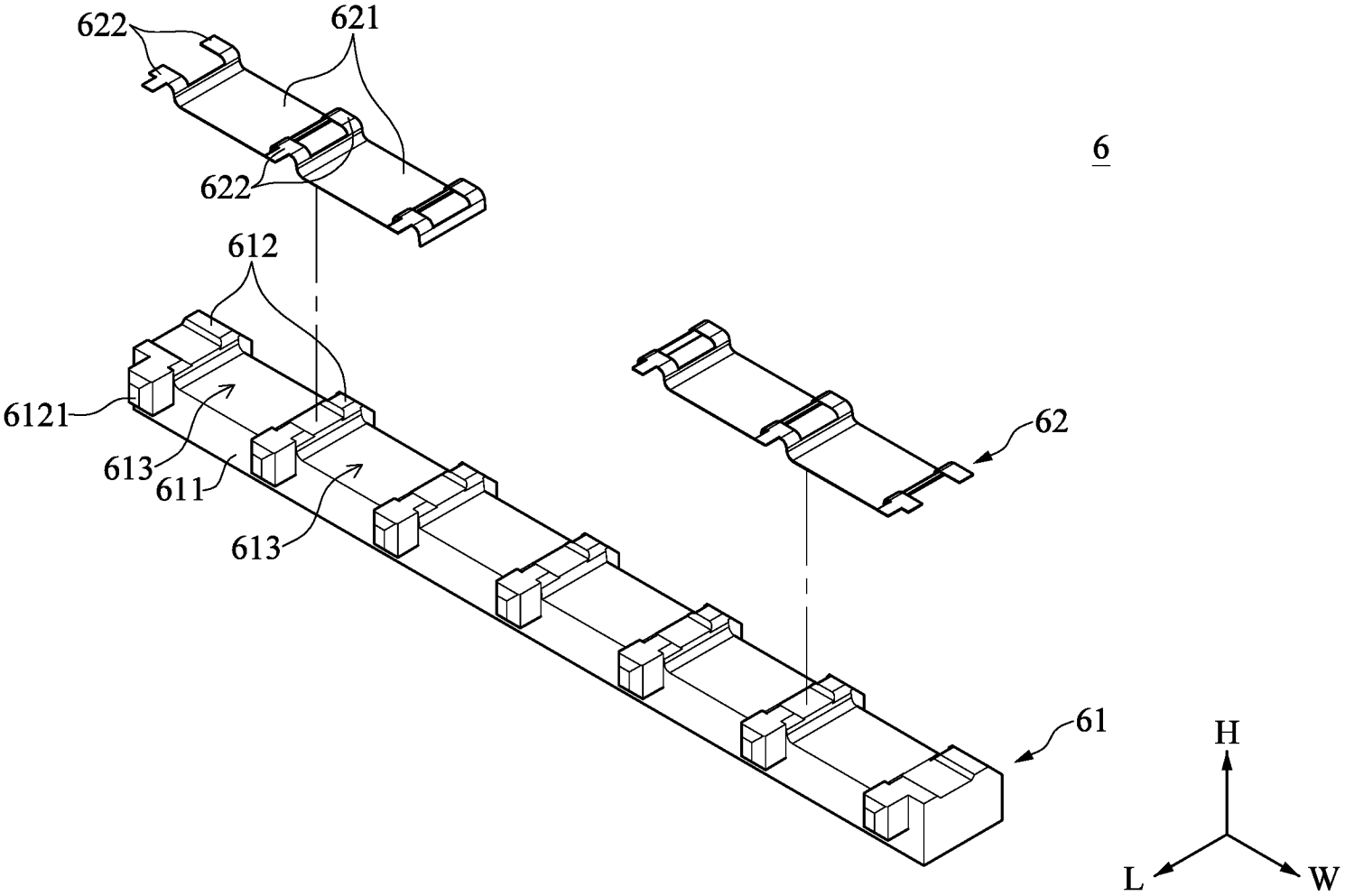
FIG. 12 is an exploded view of a second shielding member according to the present embodiment.
Figure 13:
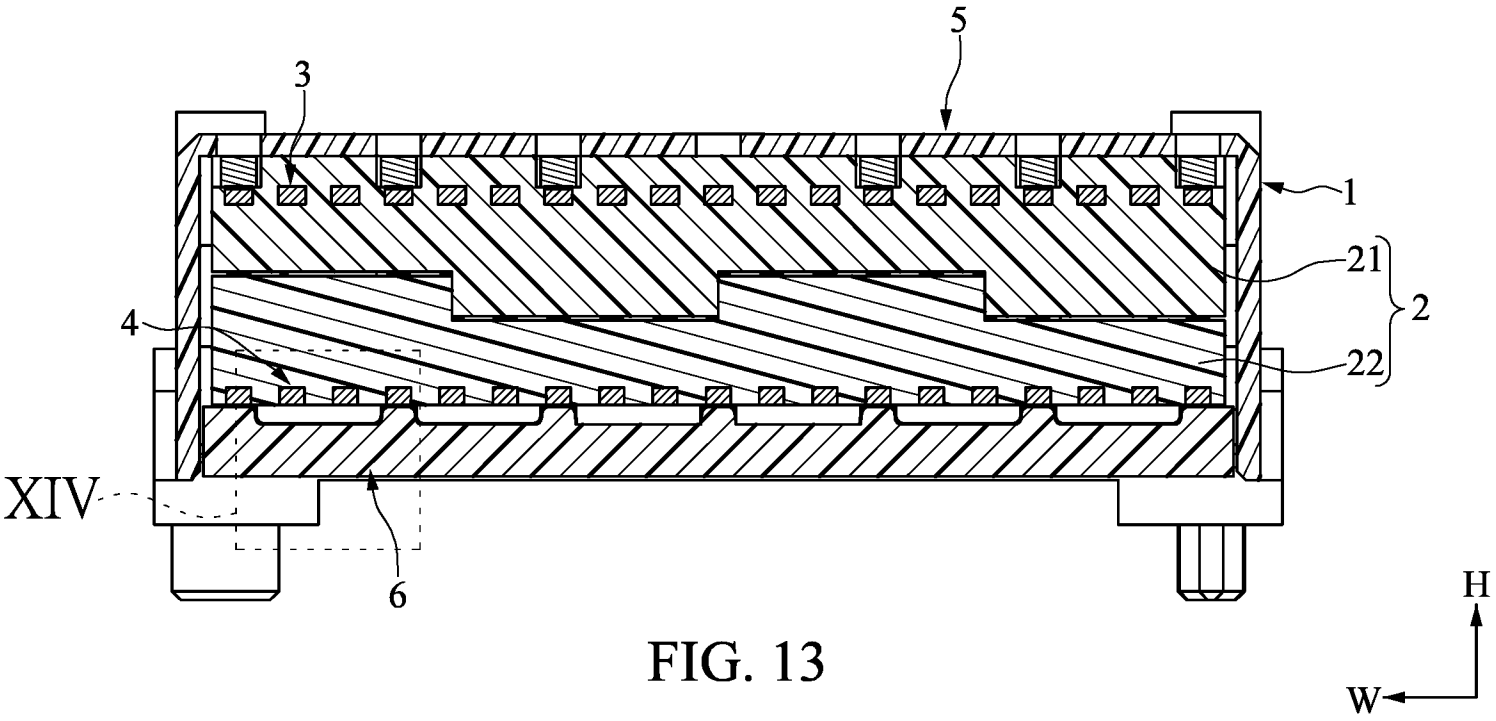
FIG. 13 is a cross-sectional view taken along a cross-sectional line of FIG. 1.
Figure 14:
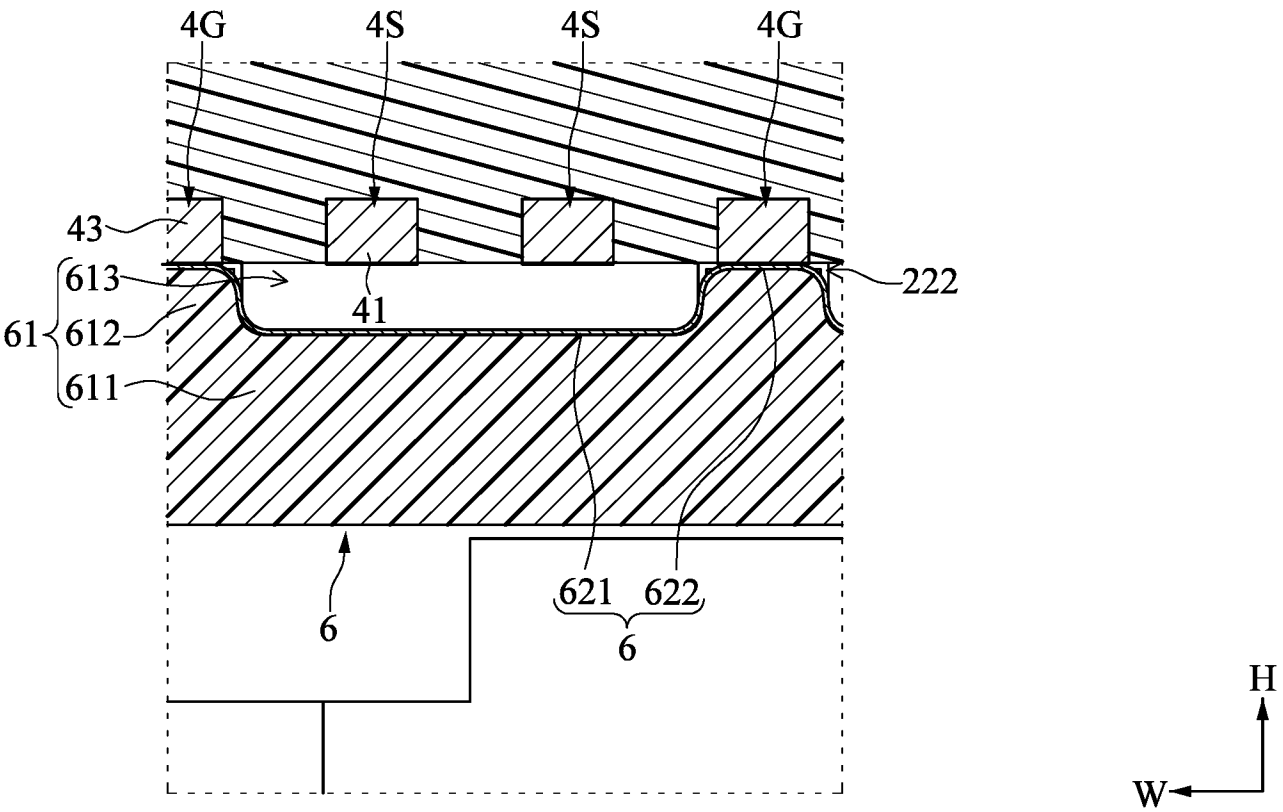
FIG. 14 is an enlarged view showing a portion XIV of FIG. 13.

Moreover, as shown in FIGS. 12 to 14, the second shielding member 6 includes a second substrate 61 and a second metallic coating layer 62 coated on the second substrate 61. The second metallic coating layer 62 can be integrally formed as a one-piece structure or can be a plurality of separated parts. The second substrate 61 in the present embodiment is integrally formed as a one-piece structure, and the second metallic coating layer 62 is abutted against at least two of the second grounding terminals 4G of the second conductive terminals 4 to establish an electrical connection between the at least two abutted second grounding terminals 4G. Thus, the second substrate 61 having a better structural strength can be configured to support the second metallic coating layer 62 by coating the second metallic coating layer 62 on the second substrate 61, so that the second metallic coating layer 62 is not easily deformed.

In should be noted that the first substrate 51 and the second substrate 61 in the present embodiment are an LDS plastic. That is to say, the first substrate 51 and the second substrate 61 are a portion of the LDS shielding member, which is not implemented in the laser structuring and activation process and the chemical coating process, so that the first substrate 51 and the second substrate 61 still have the insulating property. However, in other embodiments of the present disclosure, the first substrate 51 or/and the second substrate 61 can be a general plastic, which is not used in the LDS process. Moreover, in the present embodiment, a thickness of the first substrate 51 (or the second substrate 61) in the height direction H is preferably more than that of the first metallic coating layer 52 (or the second metallic coating layer 62), but the present disclosure is not limited thereto.

As shown in FIGS. 4A and 9-11, the first substrate 51 is detachably fastened to the first plastic core 21 and/or the housing 1. The first substrate 51 in the present embodiment includes a first base portion 511, a plurality of first ribs 512, and two hooks 513. The first base portion 511 has a substantially plate-like structure. Each of the first ribs 512 is connected to a bottom surface of the first base portion 511. Each of the two first ribs 512 includes a first protruding portion 5121 protruding from a front end of the first base portion 511. The two hooks 513 are respectively connected to two opposite sides of the first base portion 511. Any two adjacent first ribs 512 and the first base portion 511 arranged there-between jointly define a first slot 514 facing the two corresponding first differential signal terminals 3S.

The first metallic coating layer 52 includes a plurality of first shielding portions 521 and a plurality of first abutting portions 522. Two opposite sides of each first shielding portion 521 are respectively connected to at least four of the first abutting portions 522. The first shielding portions 521 of the first metallic coating layer 52 are respectively coated on inner walls of the first slots 514, and the first abutting portions 522 of the first metallic coating layer 52 are respectively coated on bottoms of the first ribs 512, each of which includes bottom of the corresponding first protruding portion 5121.

The first substrate 51 is fastened to the housing 1 by using the two hooks 513 to respectively buckle with the two positioning sheets 12. The first ribs 512 respectively correspond in position to the first grounding terminals 3G. The first protruding portions 5121 of the first substrate 51 are respectively arranged in the first notches 212 of the first plastic core 21, and the first abutting portions 522 are respectively abutted against the first external connecting portions 311 of the first grounding terminals 3G. Accordingly, the first abutting portions 522 are coated on the first protruding portions 5121 having a greater structural strength, so that when the first abutting portions 522 are respectively abutted against the first external connecting portions 311, the first protruding portions 5121 can be used to respectively support the first abutting portions 522 to prevent deformation, thereby maintaining a stable connection between each of the first abutting portions 522 and the abutted first external connecting portion 311.

Moreover, as the first differential signal terminals 3S and the first grounding terminals 3G in the present embodiment are arranged in the bilateral symmetry, and the first shielding member 5 is a mirror symmetry structure, the following description just discloses the structure of two first differential signal terminals 3S shown in the left side of FIG. 5 or the left side of FIG. 10, two first grounding terminal 3G respectively arranged at two opposite outer sides of the said two first differential signal terminals 3S, and the corresponding parts of the first shielding member 5 for the sake of brevity. Moreover, the corresponding parts of the first shielding member 5 are approximately shown in FIG. 11.

Specifically, as shown in FIGS. 5, 6, 10, and 11, the two first ribs 512 are respectively arranged at an upper side of the two first grounding terminals 3G. The first shielding portion 521 is coated on the inner wall of the first slot 514, which is arranged between the two first ribs 512, and the two first abutting portions 522 are respectively coated on the bottoms of the two first ribs 512 away from the first base portion 511, in which the bottom of each of the two first ribs 512 includes the bottom of the corresponding first protruding portion 5121. Accordingly, when the two first protruding portions 5121 are respectively arranged in the two corresponding first notches 212, the two first abutting portions 522 are respectively abutted against the two first external connecting portions 311 of the two first grounding terminals 3G.

Figure 4B:
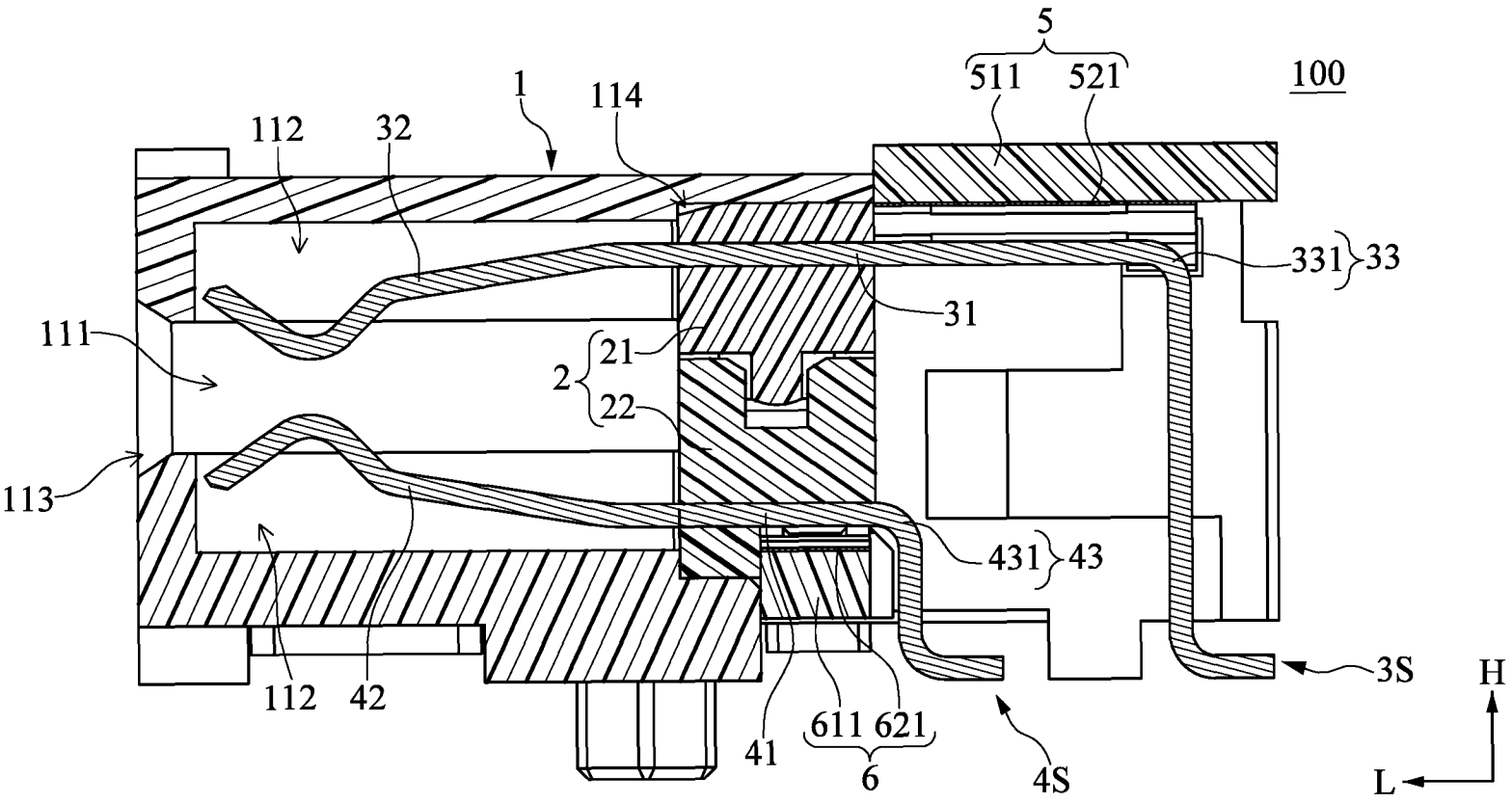
FIG. 4B is a cross-sectional view taken along a cross-sectional line IVB-IVB of FIG. 1.

Moreover, the first shielding portion 521 of the first metallic coating layer 52 is arranged at an upper side of the two first differential signal terminals 3S in the height direction H, and the first metallic coating layer 52 is configured to shield the two first differential signal terminals 3S in the height direction H. As shown in FIGS. 4B, 5, and 6, a first projecting region defined by orthogonally projecting (the first shielding portion 521 of) the first metallic coating layer 52 in the height direction H onto the two first differential signal terminals 3S shields at least 20% of each of the two first differential signal terminals 3S. Specifically, as shown in FIG. 4B, the first projecting region can shield at least 90% of the first fixing segment 33 of each of the two first differential signal terminals 3S. In other words, (the first shielding portion 521 of) the first metallic coating layer 52 is configured to shield entirely a portion of each of the two first differential signal terminals 3S, which is arranged between the insulating core 2 and the respective first bending corner 331, in the upper side of the height direction H, but the present disclosure is not limited thereto.

As shown in FIGS. 4A and 12-14, the second substrate 61 is detachably fastened to the second plastic core 22 and/or the housing 1. The second substrate 61 in the present embodiment includes a second base portion 611 and a plurality of second ribs 612. The second base portion 611 has a substantially plate-like structure. Each of the second ribs 612 is connected to a top surface of the second base portion 611. Each of the two second ribs 612 includes a second protruding portion 6121 protruding from a front end of the second base portion 611. Any two adjacent second ribs 612 and the second base portion 611 arranged there-between jointly define a second slot 613 facing the two corresponding second differential signal terminals 4S.

The second metallic coating layer 62 includes a plurality of second shielding portions 621 and a plurality of second abutting portions 622. Two opposite sides of each second shielding portion 621 are respectively connected to at least four of the second abutting portions 622. The second shielding portions 621 of the second metallic coating layer 62 are respectively coated on inner walls of the second slots 613, and the second abutting portions 622 of the second metallic coating layer 62 are respectively coated on bottoms of the second ribs 612, each of which includes bottom of the corresponding second protruding portion 6121.

The second ribs 612 respectively correspond in position to the second grounding terminals 4G. The second protruding portions 6121 of the second substrate 61 are respectively arranged in the second notches 222 of the second plastic core 22, and the second abutting portions 622 are respectively abutted against the second external connecting portions 411 of the second grounding terminals 4G. Accordingly, the second abutting portions 622 are coated on the second protruding portions 6121 having a greater structural strength, so that when the second abutting portions 622 are respectively abutted against the second external connecting portions 411, the second protruding portions 6121 can be used to respectively support the second abutting portions 622 to prevent deformation, thereby maintaining a stable connection between each of the second abutting portions 622 and the abutted second external connecting portion 411.

Moreover, as the second differential signal terminals 4S and the second grounding terminals 4G in the present embodiment are arranged in the bilateral symmetry, and the second shielding member 6 is a mirror symmetry structure, the following description just discloses the structure of two second differential signal terminals 4S shown in the left side of FIG. 7 or the left side of FIG. 13, two second grounding terminal 4G respectively arranged at two opposite outer sides of the said two second differential signal terminals 4S, and the corresponding parts of the second shielding member 6 for the sake of brevity. Moreover, the corresponding parts of the second shielding member 6 are approximately shown in FIG. 14.

Specifically, as shown in FIGS. 7, 8, 13, and 14, the two second ribs 612 are respectively arranged at a lower side of the two second grounding terminals 4G. The second shielding portion 621 is coated on the inner wall of the second slot 613, which is arranged between the two second ribs 612, and the two second abutting portions 622 are respectively coated on the bottoms of the two second ribs 612 away from the second base portion 611, in which the bottom of each of the two second ribs 612 includes the bottom of the corresponding second protruding portion 6121. Accordingly, when the two second protruding portions 6121 are respectively arranged in the two corresponding second notches 222, the two second abutting portions 622 are respectively abutted against the two second external connecting portions 411 of the two second grounding terminals 4G.

Moreover, the second shielding portion 621 of the second metallic coating layer 62 is arranged at a lower side of the two second differential signal terminals 4S in the height direction H, and the second metallic coating layer 62 is configured to shield the two second differential signal terminals 4S in the height direction H. As shown in FIGS. 4B, 7, and 8, a second projecting region defined by orthogonally projecting (the second shielding portion 621 of) the second metallic coating layer 62 in the height direction H onto the two second differential signal terminals 4S shields at least 20% of each of the two second differential signal terminals 4S. Specifically, as shown in FIG. 4A, the second projecting region can shield at least 50% of the second embedded segment 41 of each of the two second differential signal terminals 4S. In other embodiments of the present disclosure, the second shielding portion 621 of the second metallic coating layer 62 in the present embodiment can be configured to approximately shield the second embedded segment 41 of each of the two second differential signal terminals 4S in the upper side of the height direction H, but the present disclosure is not limited thereto.

In addition, the insulating core 2 (i.e., the first plastic core 21 and the second plastic core 22), the first conductive terminals 3 and the second conductive terminals 4 (i.e., the two first differential signal terminals 3S and the first grounding terminals 3G shown in the left side of FIG. 5, the corresponding two second differential signal terminals 4S, and the corresponding two second grounding terminals 4G), the first shielding member 5 (i.e., parts of the first shielding member 5 related to the two first differential signal terminals 3S and the two first grounding terminals 3G), and the second shielding member 6 (i.e., parts of the second shielding member 6 related to the two second differential signal terminals 4S and the two second grounding terminals 4G) in the present embodiment can be co-defined as a transmission module of the high speed connector 100. The components of the transmission module are not limited to the present embodiment. That is to say, in other embodiments of the present disclosure, the transmission module can be applied to the other high speed connector.

Figure 15:
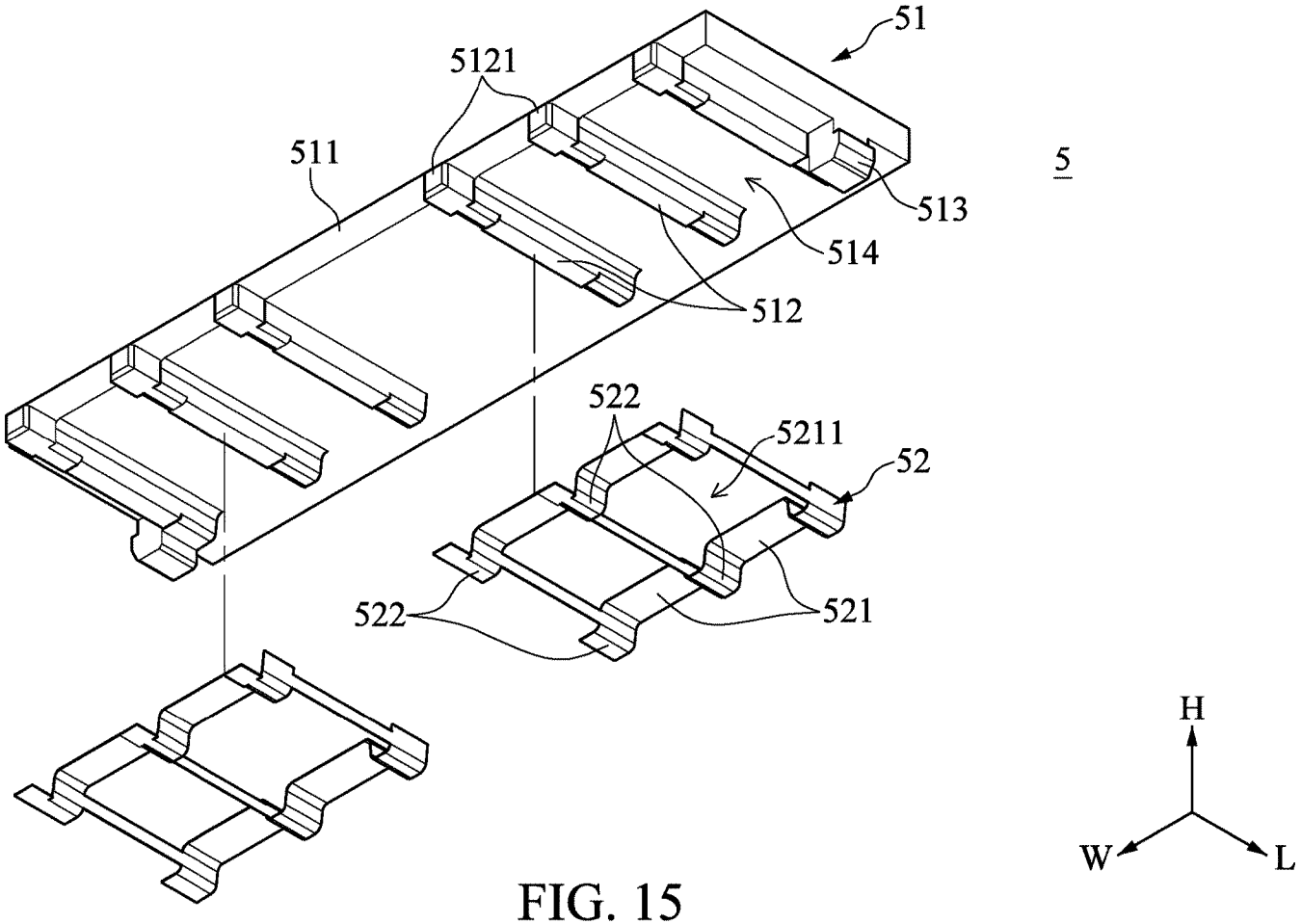
FIG. 15 is an exploded view of a first shielding member according to another embodiment of the present disclosure.

Moreover, the first shielding member 5 and the second shielding member 6 in the present disclosure can be changed or adjusted according to design requirements. For example, the first shielding member 5 can be formed in a structure as shown in FIG. 15. Specifically, the first metallic coating layer 52 includes a first shielding portion 521 and two first abutting portions 522 respectively connected to two opposite side edges of the first shielding portion 521. The first shielding portion 521 has a first opening 5211 and is coated on the inner walls of the first slot 514, and the two first abutting portions 522 are respectively coated on bottom surfaces of the two first ribs 512 away from the first base portion 511 and are respectively abutted against the two first grounding terminals 3G.

The Effects Associated with the Present Embodiment

In summary, for the high speed connector (or the transmission module) in the present disclosure, the first shielding member and the second shielding member each have a shielding function in the height direction for the first and second differential signal terminals by using the first metallic coating layer and the second metallic coating layer, so that the quality and the performance of signal transmission of the high speed connector (or the transmission module) in the present embodiment can be effectively improved.

Moreover, the first substrate and the second substrate each having a better structural strength can be configured to respectively support the first metallic coating layer and the second metallic coating layer by coating the first metallic coating layer on the first substrate and coating the second metallic coating layer on the second substrate, so that the first metallic coating layer and the second metallic coating layer are not easily deformed.

For example, the first external connecting portions are embedded in the insulating core (i.e., the first plastic core) having a greater structural strength, so that the insulating core can support each of the first external connecting portions. The first abutting portions are coated on the first protruding portions having a greater structural strength, so that the first protruding portions can respectively support the first abutting portions. Accordingly, when the first abutting portions are respectively abutted against the first external connecting portions, the first abutting portions and the first external connecting portions are not deformed easily, thereby maintaining a stable connection between each of the first abutting portions and the abutted first external connecting portion. Similarly, each of the second abutting portions and the abutted second external connecting portion in the present embodiment can be provided with a stable connection there-between.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A high speed connector, comprising:

a housing;

an insulating core inserted into the housing;

a plurality of first conductive terminals fixed on the insulating core and arranged in one row parallel to a width direction, wherein each of the first conductive terminals is substantially arranged in the housing, the first conductive terminals include two first differential signal terminals and two first grounding terminals, and the two first grounding terminals are respectively arranged at two opposite outer sides of the two first differential signal terminals;

a plurality of second conductive terminals fixed on the insulating core and arranged in one row parallel to the width direction, wherein the second conductive terminals are substantially arranged in the housing and respectively correspond in position to the first conductive terminals in a height direction perpendicular to the width direction, and a length of each of the second conductive terminals is less than or equal to that of each of the first conductive terminals, wherein the second conductive terminals include two second differential signal terminals and two second grounding terminals, and the two second grounding terminals are respectively arranged at two opposite outer sides of the two second differential signal terminals;

a first shielding member including:

a first substrate detachably fastened to the housing; and a first metallic coating layer that is coated on the first substrate, and that is abutted against the two first grounding terminals to establish an electrical connection between the two first grounding terminals, wherein the first metallic coating layer is arranged at an upper side of the two first differential signal terminals in the height direction, and the first metallic coating layer is configured to shield the two first differential signal terminals in the height direction; and a second shielding member including:

a second substrate detachably fastened to the housing; and a second metallic coating layer that is coated on the second substrate, and that is abutted against the two second grounding terminals to establish an electrical connection between the two second grounding terminals, wherein the second metallic coating layer is arranged at a lower side of the two second differential signal terminals in the height direction, and the second metallic coating layer is configured to shield the two second differential signal terminals in the height direction.

2. The high speed connector as claimed in claim 1, wherein the first substrate includes a first base portion and two first ribs connected to the first base portion, the two first ribs and the first base portion jointly define a first slot facing the two first differential signal terminals, and a part of the first metallic coating layer is coated on inner walls of the first slot; wherein the second substrate includes a second base portion and two second ribs connected to the second base portion, the two second ribs and the second base portion jointly define a second slot facing the two second differential signal terminals, and a part of the second metallic coating layer is coated on inner walls of the second slot.

3. The high speed connector as claimed in claim 2, wherein the insulating core has two first notches recessed on a side thereof and two second notches recessed on an opposite side thereof, parts of the two first grounding terminals are respectively exposed from the insulating core though the two first notches, and each is defined as a first external connecting portion, parts of the two second grounding terminals are respectively exposed from the insulating core though the two second notches, and each is defined as a second external connecting portion; wherein each of the two first ribs includes a first protruding portion protruding from the first base portion, the first metallic coating layer includes a first shielding portion and two first abutting portions respectively connected to two opposite side edges of the first shielding portion, the first shielding portion is coated on the inner walls of the first slot, and the two first abutting portions are respectively coated on bottom surfaces of the two first ribs away from the first base portion; wherein the two first protruding portions are respectively arranged in the two first notches, and the two first abutting portions are respectively abutted against the two first external connecting portions of the two first grounding terminals; wherein each of the two second ribs includes a second protruding portion protruding from the second base portion, the second metallic coating layer includes a second shielding portion and two second abutting portions respectively connected to two opposite side edges of the second shielding portion, the second shielding portion is coated on the inner walls of the second slot, and the two second abutting portions are respectively coated on bottom surfaces of the second first ribs away from the second base portion; wherein the two second protruding portions are respectively arranged in the two second notches, and the two second abutting portions are respectively abutted against the two second external connecting portions of the two second grounding terminals.

4. The high speed connector as claimed in claim 2, wherein the first metallic coating layer includes a first shielding portion and two first abutting portions respectively connected to two opposite side edges of the first shielding portion, the first shielding portion has a first opening and is coated on the inner walls of the first slot, and the two first abutting portions are respectively coated on bottom surfaces of the two first ribs away from the first base portion and are respectively abutted against the two first grounding terminals.

5. The high speed connector as claimed in claim 2, wherein the housing has an inserting opening, each of the first conductive terminals has a first embedded segment fixed and embedded in the insulating core, a first contacting segment extending from the first embedded segment toward the inserting opening, and a first fixing segment extending from the first embedded segment in a direction away from the inserting opening; wherein a first projecting region defined by orthogonally projecting the first metallic coating layer in the height direction onto the two first differential signal terminals shields at least 20% of each of the two first differential signal terminals.

6. The high speed connector as claimed in claim 5, wherein each of the second conductive terminals has a second embedded segment fixed and embedded in the insulating core, a second contacting segment extending from the second embedded segment toward the inserting opening, and a second fixing segment extending from the second embedded segment in a direction away from the inserting opening; wherein a length of each of the second embedded segments is substantially equal to that of each of the first embedded segments, a length of each of the second contacting segments is substantially equal to that of each of the first contacting segments, a length of each of the second fixing segments is less than that of each of the first fixing segments; wherein a second projecting region defined by orthogonally projecting the second metallic coating layer in the height direction onto the two second differential signal terminals shields at least 20% of each of the two second differential signal terminals.

7. The high speed connector as claimed in claim 1, wherein each of the first fixing segments has a first bending corner arranged behind a portion thereof extending from the respective first embedded segment in a longitudinal direction perpendicular to the width direction, and the first metallic coating layer is configured to shield entirely a portion of each of the two first differential signal terminals, which is arranged between the insulating core and the respective first bending corner, in an upper side of the height direction; wherein each of the second fixing segments has a second bending corner arranged behind a portion thereof extending from the respective second embedded segment and protruding from the insulating core, and the second metallic coating layer is configured to shield at least 50% of the second embedded segment of each of the two second differential signal terminals in a lower side of the height direction.

8. The high speed connector as claimed in claim 1, wherein each of the first shielding member and the second shielding member is an LDS shielding member.

9. A transmission module of a high speed connector, comprising:

an insulating core;

two first differential signal terminals and two first grounding terminals respectively arranged at two opposite outer sides of the two first differential signal terminals, wherein a length of each of the two first differential signal terminals is substantially equal to that of each of the two first grounding terminals, and the two first differential signal terminals and the two first grounding terminals are fixed on the insulating core and are arranged in one row parallel to a width direction;

two second differential signal terminals and two second grounding terminals respectively arranged at two opposite outer sides of the two second differential signal terminals, wherein a length of each of the two second differential signal terminals is substantially equal to that of each of the two second grounding terminals, and is less than the length of each of the two first differential signal terminals, wherein the two second differential signal terminals and the two second grounding terminals are fixed on the insulating core, are arranged in one row parallel to the width direction, and respectively correspond in position to the first conductive terminals in a height direction perpendicular to the width direction;

a first shielding member including:

a first substrate; and a first metallic coating layer that is coated on the first substrate, and that is abutted against the two first grounding terminals to establish an electrical connection between the two first grounding terminals, wherein the first metallic coating layer is arranged at an upper side of the two first differential signal terminals in the height direction, and the first metallic coating layer is configured to shield the two first differential signal terminals in the height direction;

a second shielding member including:

a second substrate; and a second metallic coating layer that is coated on the second substrate, and that is abutted against the two second grounding terminals to establish an electrical connection between the two second grounding terminals, wherein the second metallic coating layer is arranged at a lower side of the two second differential signal terminals in the height direction, and the second metallic coating layer is configured to shield the two second differential signal terminals in the height direction.

10. The transmission module as claimed in claim 9, wherein each of the first shielding member and the second shielding member is an LDS shielding member; wherein the first substrate includes a first base portion and two first ribs connected to the first base portion, the two first ribs and the first base portion jointly define a first slot facing the two first differential signal terminals, and a part of the first metallic coating layer is coated on inner walls of the first slot; wherein the second substrate includes a second base portion and two second ribs connected to the second base portion, the two second ribs and the second base portion jointly define a second slot facing the two second differential signal terminals, and a part of the second metallic coating layer is coated on inner walls of the second slot.

* * * * *